US011156016B2

(12) United States Patent
Riley et al.

(10) Patent No.: US 11,156,016 B2
(45) Date of Patent: Oct. 26, 2021

(54) ANTI-LIGATURE TURN PIECE

(71) Applicant: Sargent Manufacturing Company, New Haven, CT (US)

(72) Inventors: Daniel Riley, Easton, CT (US); Eric Palmieri, New Haven, CT (US); Tracy F. Fowler, New Haven, CT (US); Lee Griswold, Bethel, CT (US)

(73) Assignee: SARGENT MANUFACTURING COMPAY, New Haven, CT (US)

( * ) Notice: Subject to any disclaimer, the term of this patent is extended or adjusted under 35 U.S.C. 154(b) by 527 days.

(21) Appl. No.: 15/994,158

(22) Filed: May 31, 2018

(65) Prior Publication Data

US 2018/0347229 A1 Dec. 6, 2018

Related U.S. Application Data

(60) Provisional application No. 62/512,873, filed on May 31, 2017.

(51) Int. Cl.
*E05B 3/06* (2006.01)
*E05B 15/02* (2006.01)
(Continued)

(52) U.S. Cl.
CPC ..... *E05B 3/06* (2013.01); *E05B 1/003* (2013.01); *E05B 15/02* (2013.01); *E05B 65/0017* (2013.01)

(58) Field of Classification Search
CPC ... Y10T 292/57; Y10T 292/82; Y10T 292/85; Y10T 292/873; Y10T 292/91;
(Continued)

(56) References Cited

U.S. PATENT DOCUMENTS 352,213 A * 11/1886 White ..... E05B 65/0811 70/97
1,326,450 A * 12/1919 Howard et al. ..... E05B 1/0015 49/460
(Continued)

FOREIGN PATENT DOCUMENTS

BE 1008810 8/1996
DE 10053062 A1 5/2002
(Continued)

*Primary Examiner* — Alyson M Merlino
(74) *Attorney, Agent, or Firm* — DeLio Peterson & Curcio LLC; David R. Pegnataro

(57) ABSTRACT

An anti-ligature handle and escutcheon mechanism mountable on a door for operating a lock for securing the door. The mechanism comprises a handle movable between open and closed positions, the handle having a smoothly curved outer surface to prevent the attachment of a ligature thereto and comprising a pivot at a first end for rotating the handle between the open and closed positions to operate the lock. An escutcheon fixed relative to a backing plate is oriented for mounting parallel to the door when the mechanism is mounted on an outer surface of the door, wherein the escutcheon surrounds the handle and defines a recessed area within which the handle pivots. The handle further has a second end including a guide which is trapped beneath and slides along an arcuate edge of the recessed area of the escutcheon to maintain flush contact between a mating surface of the handle and the backing plate to prevent ligatures from being inserted therebetween as the handle rotates to operate the lock. The mechanism further comprises a mounting plate disposed between the backing plate and an inner surface of the door when the mechanism is mounted on the outer surface of the door, the mounting plate fixed relative to the escutcheon and backing plate.

20 Claims, 10 Drawing Sheets

(51) Int. Cl.
*E05B 65/00* (2006.01)
*E05B 1/00* (2006.01)

(58) Field of Classification Search
CPC ... Y10T 16/458; Y10T 16/46; Y10T 16/4636; Y10T 16/464; Y10T 16/476; Y10T 70/5155; Y10T 70/5173; Y10T 70/5177; Y10T 70/5181; Y10T 70/5186; Y10T 70/519; Y10T 70/5195; Y10T 70/5757; Y10T 70/5761; Y10T 70/5765; Y10T 70/577; Y10T 70/5832; Y10S 292/65; E05B 1/00; E05B 1/0007; E05B 1/003; E05B 1/04; E05B 65/00; E05B 65/0017; E05B 65/0032; E05B 5/00; E05B 3/06; E05B 15/02
See application file for complete search history.

(56) References Cited

U.S. PATENT DOCUMENTS

| | | | | |
|---|---|---|---|---|
| 2,744,406 | A | 5/1956 | Labrie | |
| 3,713,683 | A | 1/1973 | Neary | |
| 4,064,721 | A | 12/1977 | Morgan | |
| 4,575,141 | A | 3/1986 | Burns | |
| 5,303,965 | A | 4/1994 | Meehan | |
| 6,352,289 | B1 * | 3/2002 | Fan | E05B 13/004 292/226 |
| 7,373,694 | B1 | 5/2008 | Kopp | |
| 7,802,828 | B2 | 9/2010 | Hopkins et al. | |
| D646,233 | S | 10/2011 | Reddering | |
| 8,122,745 | B2 | 2/2012 | Ramsauer et al. | |
| D680,849 | S | 4/2013 | Berger et al. | |
| 8,534,723 | B2 | 9/2013 | Berger | |
| D690,577 | S | 10/2013 | Eller et al. | |
| 8,584,494 | B2 | 11/2013 | Salvatore et al. | |
| 8,991,881 | B2 | 3/2015 | Shilts | |
| 9,033,375 | B1 | 5/2015 | Moon | |
| 9,249,599 | B2 | 2/2016 | Berger et al. | |
| 9,290,963 | B2 | 3/2016 | Berger et al. | |
| D761,079 | S | 7/2016 | Groleski | |
| 9,859,069 | B2 | 1/2018 | Sambar | |
| D813,644 | S | 3/2018 | Finkelstein et al. | |
| D818,790 | S | 5/2018 | Ito et al. | |
| D843,811 | S * | 3/2019 | Riley | D8/331 |
| 2001/0028172 | A1 | 10/2001 | Bates et al. | |
| 2003/0226384 | A1 | 12/2003 | Shedd et al. | |
| 2010/0013248 | A1 | 1/2010 | Keller | |
| 2010/0072762 | A1 | 3/2010 | Marks | |
| 2011/0120024 | A1 | 5/2011 | Shilts | |
| 2011/0174026 | A1 | 7/2011 | Salvatore et al. | |
| 2012/0073338 | A1 | 3/2012 | Mohla | |
| 2013/0168519 | A1 | 7/2013 | In et al. | |
| 2014/0311194 | A1 | 10/2014 | Berger et al. | |
| 2015/0130197 | A1 | 5/2015 | Eller et al. | |
| 2015/0211253 | A1 | 7/2015 | Shah et al. | |
| 2016/0237719 | A1 | 8/2016 | Clifford | |

FOREIGN PATENT DOCUMENTS

| | | | |
|---|---|---|---|
| EP | 1927709 | A2 | 6/2008 |
| GB | 2276659 | A | 5/1994 |
| GB | 2413068 | A | 10/2005 |
| GB | 2459884 | A | 11/2009 |
| JP | S4521044 | | 8/1970 |
| JP | S5010477 | | 1/1979 |
| JP | 895580 | | 4/1994 |
| JP | 2004162401 | A | 6/2004 |
| JP | 2004324250 | A | 11/2004 |
| WO | 2010092398 | A1 | 8/2010 |

* cited by examiner

ANTI-LIGATURE TURN PIECE

RELATED APPLICATIONS

This application claims priority to U.S. Provisional Patent App. No. 62/512,873 filed on May 31, 2017, the entire disclosure of which is incorporated herein by reference.

BACKGROUND OF THE INVENTION

1. Field of the Invention

The present invention relates generally to anti-ligature lock mechanisms, escutcheons and door handles designed to prevent suicide by preventing the attachment of a ligature to the door handle or the lock mechanism. More specifically, the present invention relates to an anti-ligature turn piece and escutcheon wherein the turn piece pivots within a recess in the escutcheon and includes a guide trapped beneath and sliding along an edge of the recessed area of the escutcheon to maintain the turn piece in flush contact with a backing plate to prevent insertion of a ligature therebetween as the turn piece rotates to operate the lock.

2. Description of Related Art

Buildings such as hospitals, mental health facilities, prisons, detention centers and the like are locations where patients, inmates and detainees are subject to stress and high levels of emotion. Under such circumstances, there is an increased risk of suicide by those within. Such events may be referred to as "sentinel events."

A common type of attempted suicide or self-harm is by hanging or strangulation by attaching a ligature, such as clothing or a belt, to a conventional door knob or lever handle. Because it is not possible for all patients and inmates to be continuously monitored, public buildings of the aforementioned type are increasingly being provided with specially designed anti-ligature locks and door handles. The use of such anti-ligature locks and handles can significantly reduce or eliminate the occurrence of sentinel events, i.e., suicide and/or self-inflicted injuries.

A conventional knob or lever handle allows clothing or a belt to be attached to the handle of the lock mechanism. Anti-ligature locks and door handles function by eliminating projections and hanging points, which prevents clothing or belts from being attached to the handle.

However, by eliminating such projections, conventional anti-ligature handles are often difficult to grasp and operate. This is a particular problem in hospitals where the elderly, those with infirmities, and/or those with limited use of their hands, must be able to operate the door. There is a need for an anti-ligature lock and escutcheon mechanism having a handle design that is as easily operated as a lever handle or thumb turn.

Many attempted suicides involve the use of clothing or a belt as a ligature, However, even where an anti-ligature handle has been installed, a patient intent on self-harm may attempt to insert a small diameter ligature, such as dental floss or thread, into joints or spaces between moving handle components.

Such joints would not normally provide a hanging point for clothing, belts, or ropes. However, when multiple threads or lengths of dental floss are combined, it may still be possible for a conventionally designed anti-ligature lock or door handle to provide a hanging point. There is therefore a need for an anti-ligature lock handle design that prevents small diameter ligatures from being inserted into gaps, spaces or joints in the handle to eliminate all hanging points for such small diameter ligatures.

Another problem with conventional anti-ligature lock handles is that they do not have an attractive appearance. There is thus a need for an anti-ligature lock handle design that is attractive and provides a modern appearance.

SUMMARY OF THE INVENTION

Bearing in mind the problems and deficiencies of the prior art, it is therefore an object of the present invention to provide an anti-ligature lock having a handle or turn-piece that does not allow the end of a ligature to be secured to the handle.

It is another object of the present invention to provide an anti-ligature lock having a door handle where there is no gap or access between the handle and the surface of the door into which a ligature could be inserted.

A further object of the invention is to provide an anti-ligature lock having a door handle where there is no gap or access between the handle and escutcheon into which a ligature could be inserted.

It is yet another object of the present invention to provide an anti-ligature lock mechanism having an escutcheon shaped to hide a pivoting end of the door handle.

It is still yet another object of the present invention to provide an anti-ligature lock mechanism wherein the handle pivots within a recess in an escutcheon and wherein the handle includes a guide trapped beneath and sliding along an edge of the recessed area of the escutcheon to prevent insertion of a ligature therebetween as the handle rotates to operate the lock.

Still other objects and advantages of the present invention will in part be obvious and will in part be apparent from the specification.

The above and other objects, which will be apparent to those skilled in the art, are achieved in the present invention, which is directed to an anti-ligature handle and escutcheon mechanism mountable on a door for operating a lock for securing the door. The anti-ligature handle and escutcheon mechanism comprises a handle movable between an open and a closed position and comprising a pivot at a first end for rotating the handle between the open and closed positions to operate the lock, the handle having a smoothly curved outer surface to prevent the attachment of a ligature thereto. An escutcheon shaped to hide the pivot and first end of the handle is oriented for mounting parallel to the door when the anti-ligature handle and escutcheon mechanism is mounted on an outer surface of the door. A backing plate is oriented for mounting parallel to the door when the anti-ligature handle and escutcheon mechanism is mounted on the outer surface of the door, a mating surface of the handle being in flush contact with the backing plate as the handle moves to operate the lock to prevent ligatures from being inserted between the handle and the backing plate. The escutcheon is fixed relative to the backing plate to prevent ligatures from being inserted therebetween, and the escutcheon is smoothly curved and provides no projections or hanging points.

The escutcheon may surround the handle and may comprise a covering for hiding the pivot and first end of the handle. In an embodiment, the escutcheon may define a recessed area within which the handle pivots. The recessed area may be shaped approximately as a segmental arch, wherein the first end of the handle pivots from a point approximately opposite an apex of the arched recessed area. Opposing edges of the arched recessed area may be straight lines emanating from a center point of the handle first end, and the handle may comprise substantially straight edges which abut opposing edges of the recessed area when the handle is in a fully closed or fully open position, respectively, as the handle pivots to operate the lock.

The handle may have a substantially uniform width from the first end to a second end opposite the first end, and may be smoothly curved and shaped to allow a user to grip within depressions on opposing sides of the handle, but without providing an opening within the handle. At least a portion of the handle may have a flattened surface to allow a user to press the flattened surface of the handle inwards toward the backing plate without gripping the handle to pivot the handle to operate the lock. The handle includes a second end, the handle second end moving from near a first edge of the arched recessed area to near a second edge of the arched recessed area as the handle pivots to operate the lock.

The handle second end may include a guide which is trapped beneath and slides along an arcuate edge of the recessed area of the escutcheon as the handle is rotated to operate the lock. In an embodiment, the arcuate edge of the recessed area of the escutcheon may further comprise a lip extending along at least a portion thereof, the lip trapping the guide between an inside edge of the escutcheon and the backing plate to maintain flush contact between the mating surface of the handle and the backing plate as the handle is rotated to operate the lock, wherein the flush contact between the handle and the backing plate prevents insertion of a ligature therebetween.

The backing plate may further comprise an aperture for receiving at least a portion of the handle pivot therethrough. The escutcheon has a back surface comprising a rear recessed portion, wherein the backing plate is positioned within the escutcheon rear recessed portion such that a periphery of the escutcheon is permitted to be in flush contact with the outer surface of the door when mounted thereon. The escutcheon back surface may further comprise a pair of studs extending therefrom and the backing plate may comprise a pair of blind holes for receiving the studs to attach the backing plate to the escutcheon.

In an embodiment, the anti-ligature handle and escutcheon mechanism may further comprise a mounting plate disposed between the backing plate and an inner surface of the door when the anti-ligature handle and escutcheon mechanism is mounted on the outer surface of the door, the mounting plate fixed relative to the escutcheon and backing plate. The mounting plate may be offset a predetermined distance from the escutcheon and backing plate such that the escutcheon can be mounted flush with the outer surface of the door. The mounting plate may comprise at least one internally threaded post for receiving a fastener passing through the backing plate between the escutcheon and the mounting plate, and may further comprise an aperture for receiving a fastener inserted therein to secure the mounting plate to the inner surface of the door.

In another aspect, the present invention is directed to a method of operating a lock for securing a door, comprising: providing an anti-ligature handle and escutcheon mechanism mounted on an outer surface of the door, the anti-ligature handle and escutcheon mechanism comprising: a handle movable between an open and a closed position, the handle having a smoothly curved outer surface to prevent the attachment of a ligature thereto and comprising a pivot at a first end for rotating the handle between the open and closed positions to operate the lock and a second end including a guide; an escutcheon surrounding the handle and defining a recessed area within which the handle pivots, the escutcheon shaped to hide the pivot and first end of the handle; and a backing plate mounted parallel to the outer surface of the door, the backing plate fixed relative to the escutcheon to prevent ligatures from being inserted between the escutcheon and backing plate. The method further comprises trapping the handle second end guide beneath an arcuate edge of the recessed area of the escutcheon such that the handle second end guide is permitted to slide along the arcuate edge as the handle is rotated between open and closed positions to operate the lock, and rotating the handle between open and closed positions while maintaining a mating surface of the handle in flush contact with the backing plate as the handle moves to operate the lock to prevent ligatures from being inserted between the handle and the backing plate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
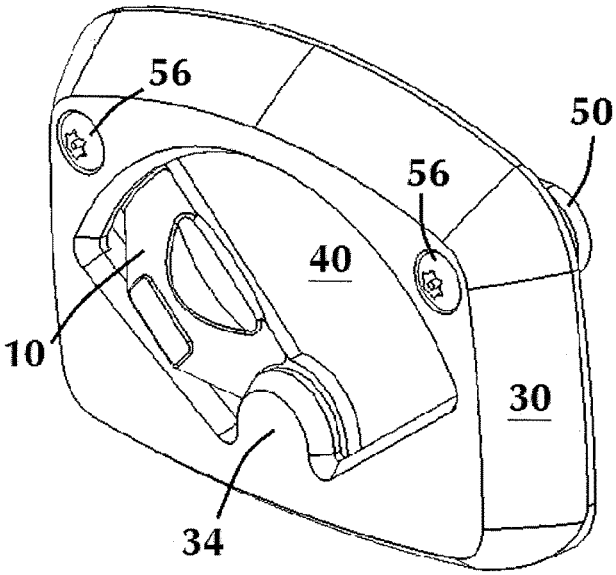
FIG. 1 is a perspective view of an embodiment of an anti-ligature turn piece and escutcheon according to the present invention.
Figure 2:
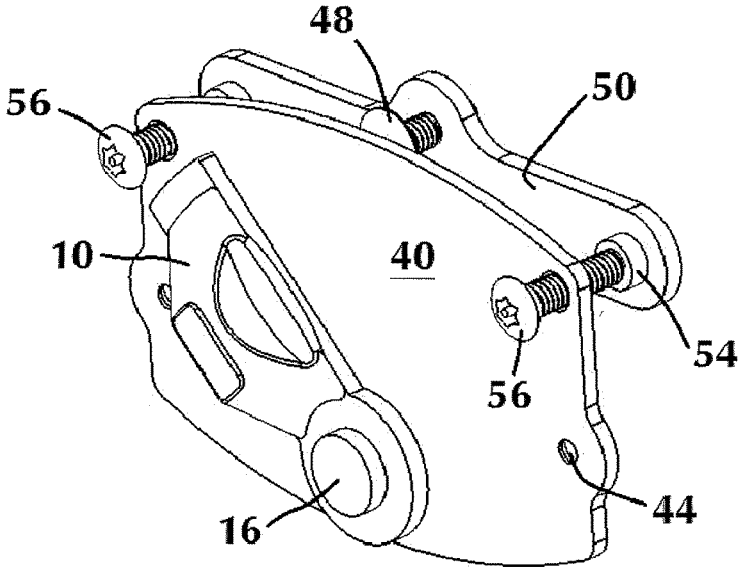
FIG. 2 is a perspective view of the anti-ligature turn piece and escutcheon shown in FIG. 1, with the escutcheon removed to show the handle or turn piece in flush contact with the backplate.

In describing the embodiments of the present invention, reference will be made herein to FIGS. 1-16 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," and "counterclockwise" merely describe the configuration shown in the drawings. For purposes of clarity, the same reference numbers will be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

The present invention is directed to an anti-ligature handle or turn piece and surrounding escutcheon for use in connection with a lock mechanism installed in a door. As will be described in more detail below, the turn piece pivots within a recessed area in the escutcheon and includes a guide trapped beneath and sliding along an arcuate edge of the recessed area to maintain the turn piece in flush contact with a backing plate to prevent insertion of a ligature therebetween as the turn piece rotates to operate the lock. A door and a mortise lock are alternately shown in the Figures herein in solid line and phantom line to indicate that the anti-ligature handle or turn piece and escutcheon may be used with various locks and door types.

Figure 3:
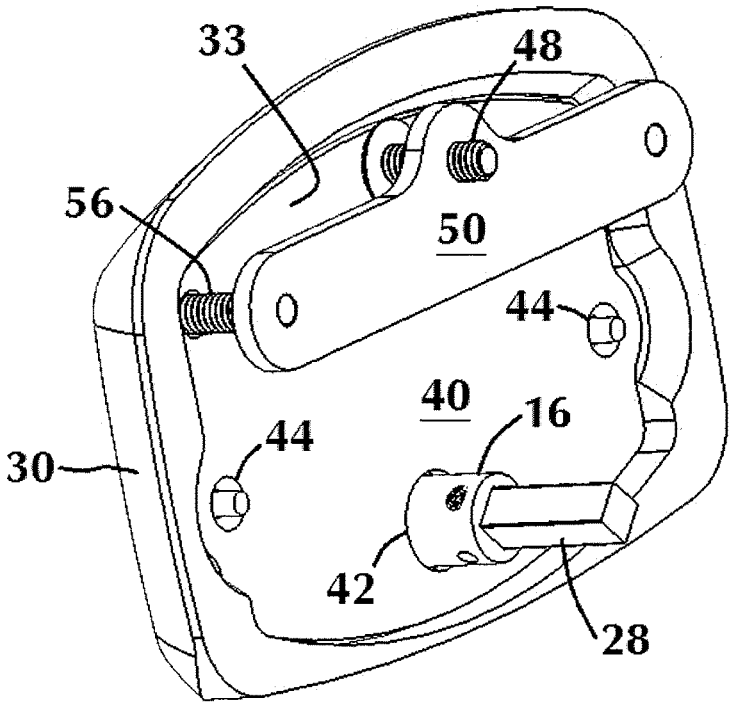
FIG. 3 is a rear perspective view of the anti-ligature turn piece and escutcheon shown in FIG. 1.
Figure 4:
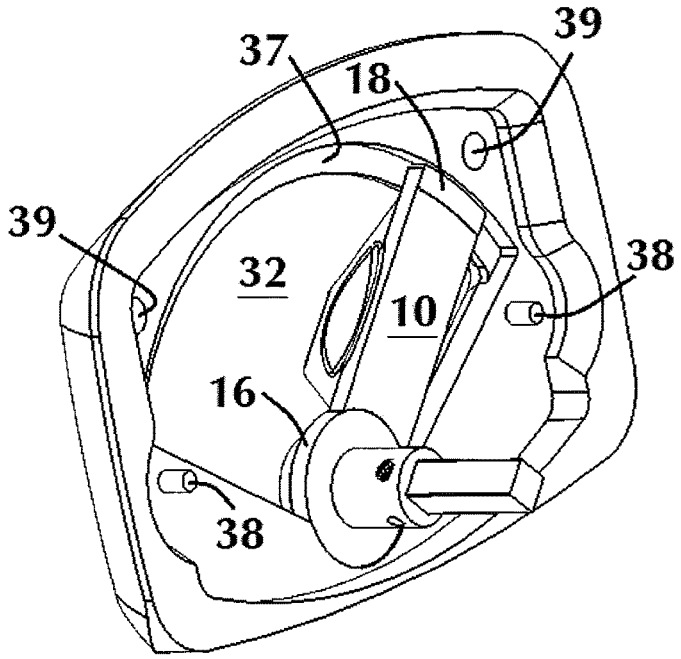
FIG. 4 is a rear perspective view of the anti-ligature turn piece and escutcheon shown in FIG. 3, with the backplate and mounting plate removed to show the rear surfaces of the handle and escutcheon.
Figure 5:
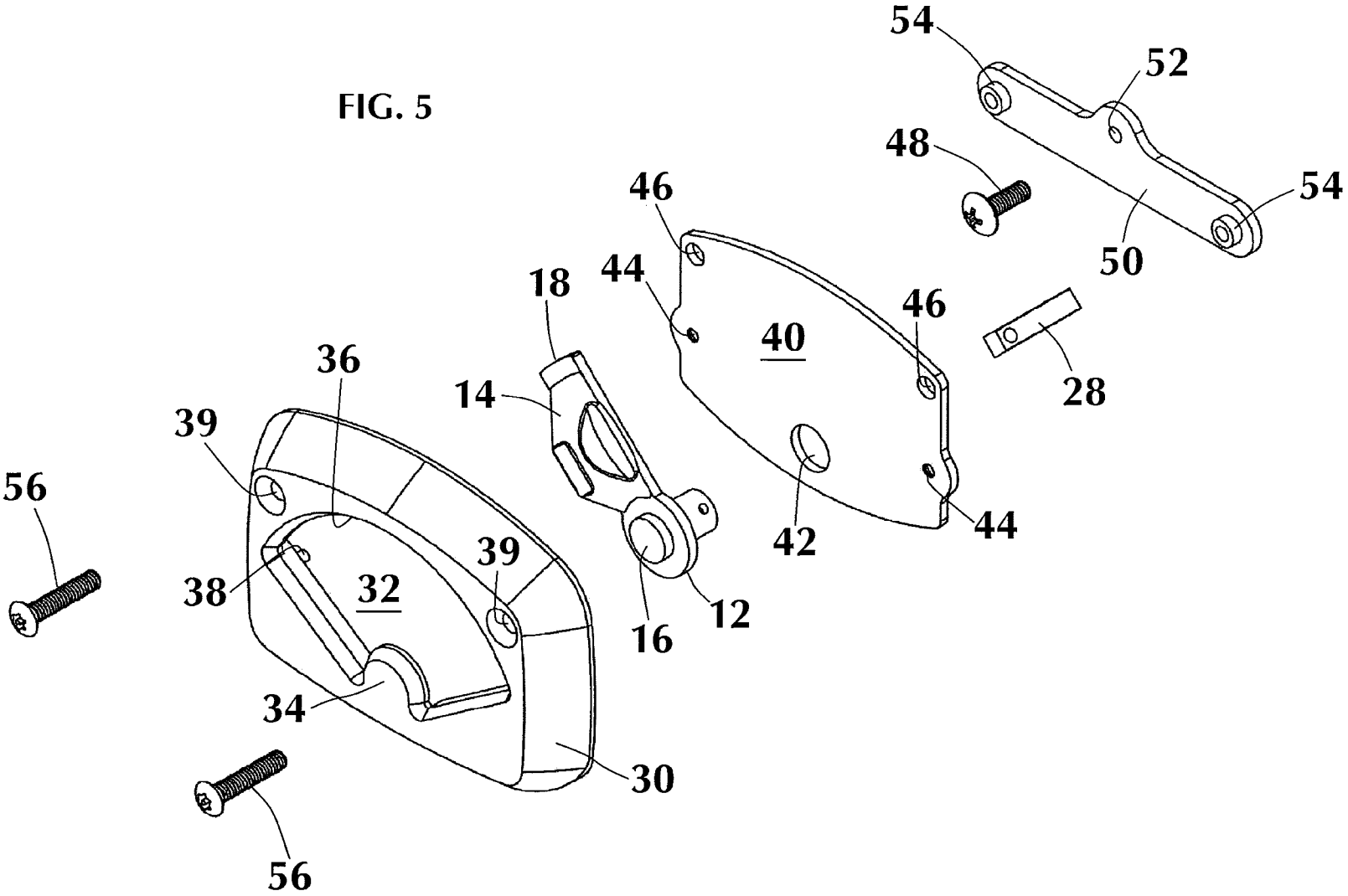
FIG. 5 is an exploded view of the anti-ligature turn piece and escutcheon shown in FIG. 1.
Figure 6:
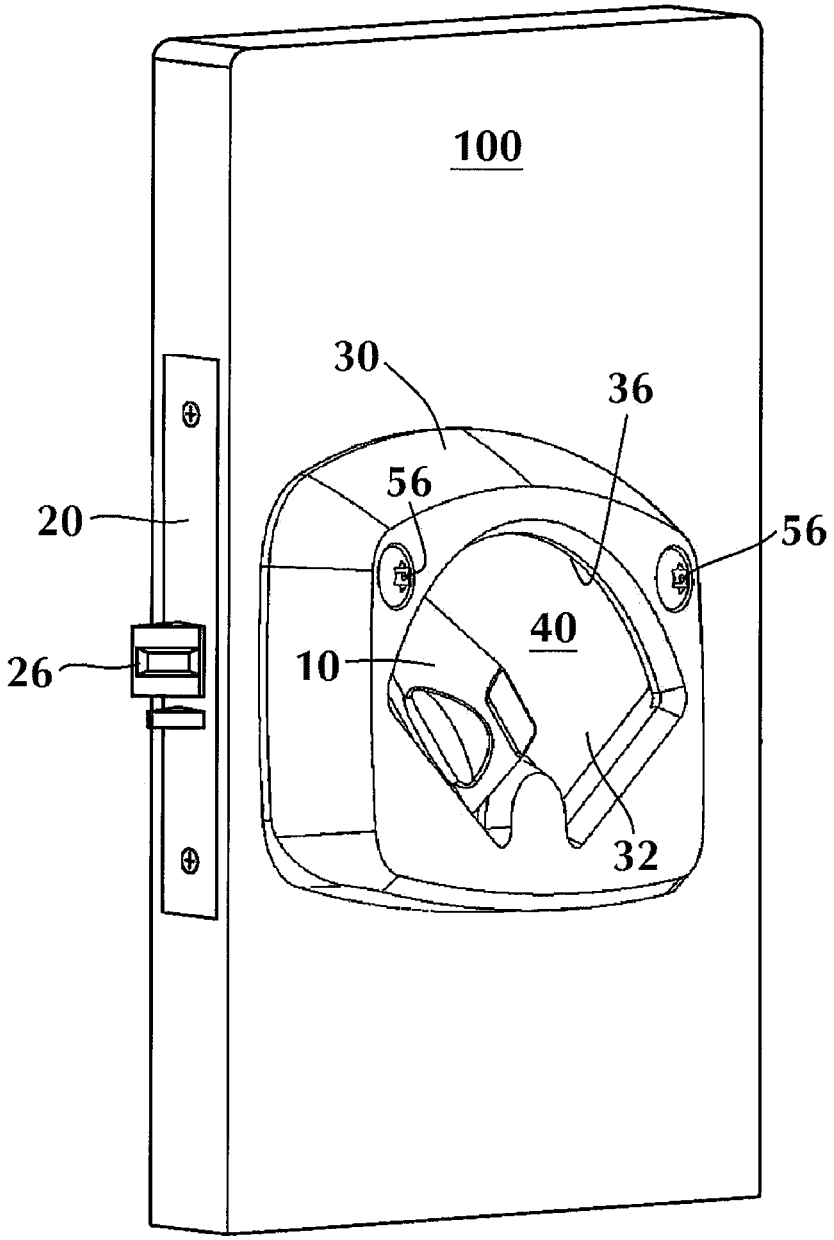
FIG. 6 is a perspective view of the anti-ligature handle and escutcheon mechanism of FIG. 1 installed on a door. The anti-ligature handle and escutcheon are shown in exaggerated size, as compared to the door, for clarity.

Referring now to FIGS. 1-5, an embodiment of an anti-ligature handle or turn piece and escutcheon according to the present invention is shown. As shown in the Figures, handle 10 may be shaped as a thumb turn, which rotates about a pivot 16 at a first end 12 of the handle to operate a lock mechanism 20 installed in door 100 9 (FIG. 6). Although referred to herein as a "thumb" turn, it should be understood by those skilled in the art that any single finger, multiple fingers, or other body part or apparatus can be used to easily operate the handle or thumb turn 10. A spindle 28 (as shown in FIGS. 3-5) extends from the lower end 12 of the thumb turn perpendicularly through opening 42 in backing plate 40 and the exterior or outer surface of the door and into operating engagement with a lock mechanism 20 (FIG. 6). As further shown in FIG. 5, handle 10 includes a second end 14 opposite the first end, which is retained under an arcuate edge of escutcheon 30 by guide 18 as the handle rotates to operate the lock, as will be described below.

Figure 16:
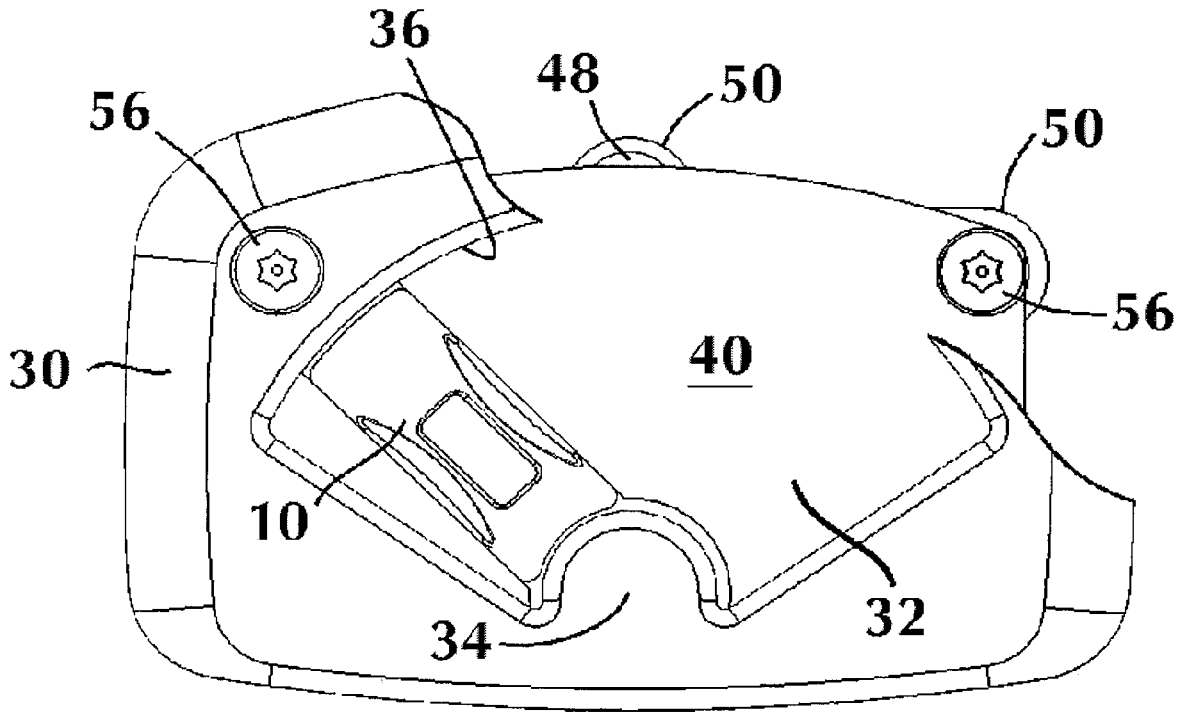
FIG. 16 shows a front elevational view of the anti-ligature turn piece and escutcheon shown in FIG. 1, with an upper portion of the escutcheon cut away. The upper portion of the backplate can be seen behind the escutcheon, with the mounting plate offset behind and fixed relative to the escutcheon and backplate.

Handle 10 rotates within an approximately arch-shaped recess 32 in an escutcheon 30 that surrounds the handle or thumb turn 10. Recess 32 is formed as an approximately segmental arch opening in the front surface of escutcheon 30. The back of the opening forming recess 32 is closed off with a backing plate 40. The backing plate 40 and escutcheon 30 are mounted and oriented parallel to the door, and fixed relative to the door surface and to each other (FIGS. 8-16). As shown in FIG. 16, backing plate 40 is larger than and visible within recess 32 and partially hidden beneath escutcheon 30. As will be described below, and as best seen in FIG. 3, backing plate 40 is disposed within a back portion of the escutcheon 30 via a rear recess, such that a periphery of the escutcheon is permitted to be in flush contact with the outer surface of the door when mounted thereon (FIGS. 8-15). Studs extending from the back surface of escutcheon 30 mate with blind holes in backing plate 40 to attach the backing plate and escutcheon, providing a dead end at the side angled portions of recess 32. The escutcheon 30 and the backing plate 40 form a stationary unit which is fixed relative to the door 100.

Figure 7:
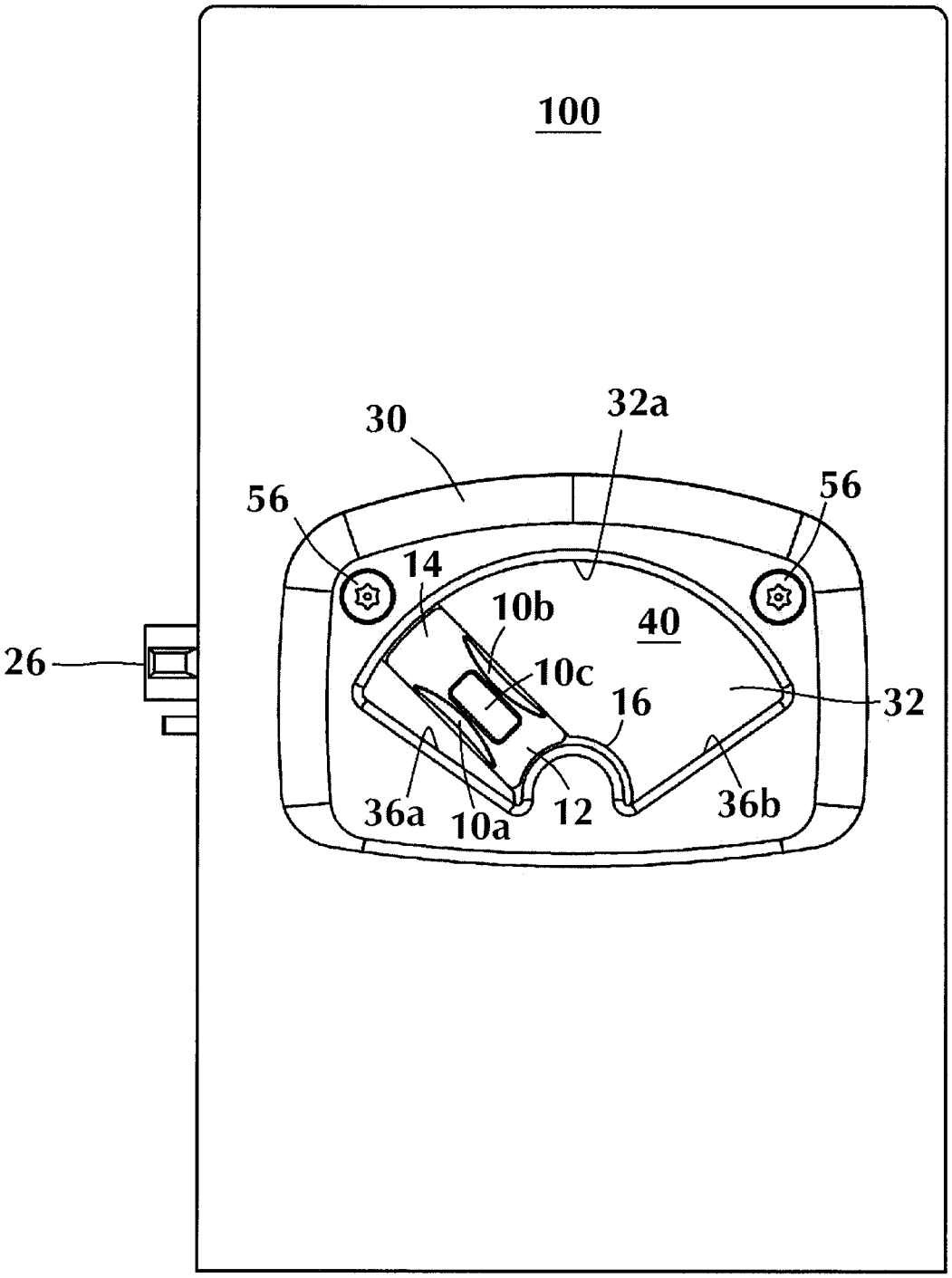
FIG. 7 is a front elevational view of FIG. 6. The handle or turn piece is shown in a partially-rotated position (from left to right).
Figure 8:
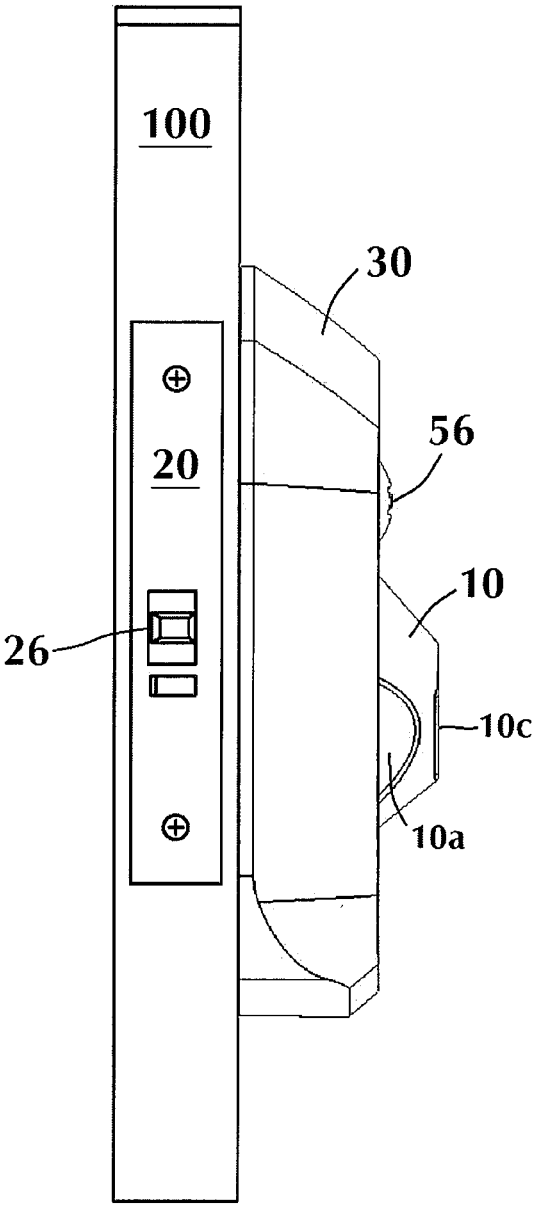
FIGS. 8 and 9 are left and right side elevational views of FIG. 6.
Figure 9:
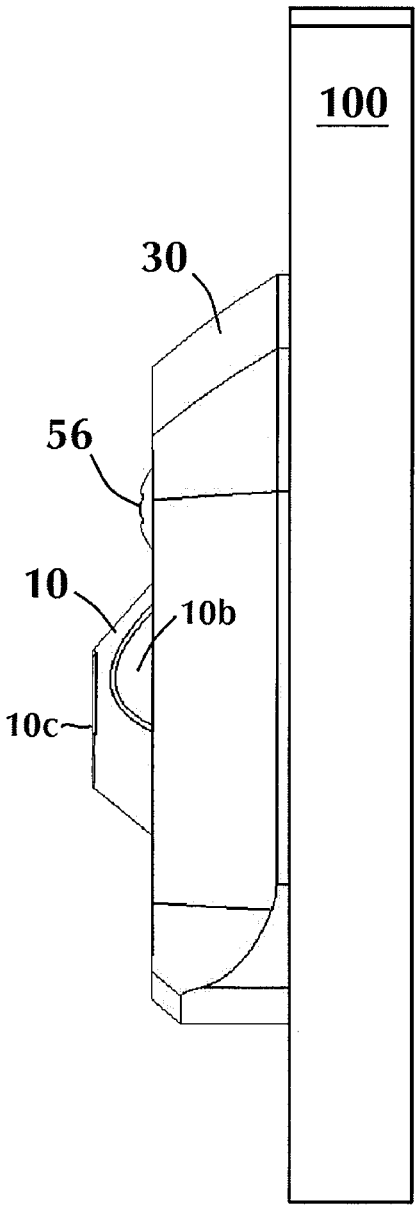
Figure 10:
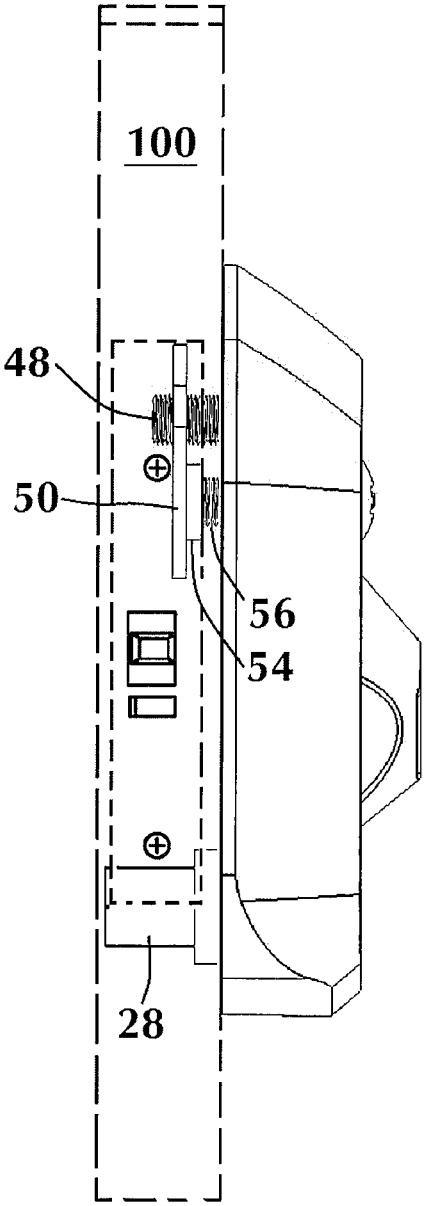
FIGS. 10 and 11 show left and right side elevational views of FIG. 6, with the exterior surface of the door in phantom line to show the mounting plate embedded within the door.
Figure 11:
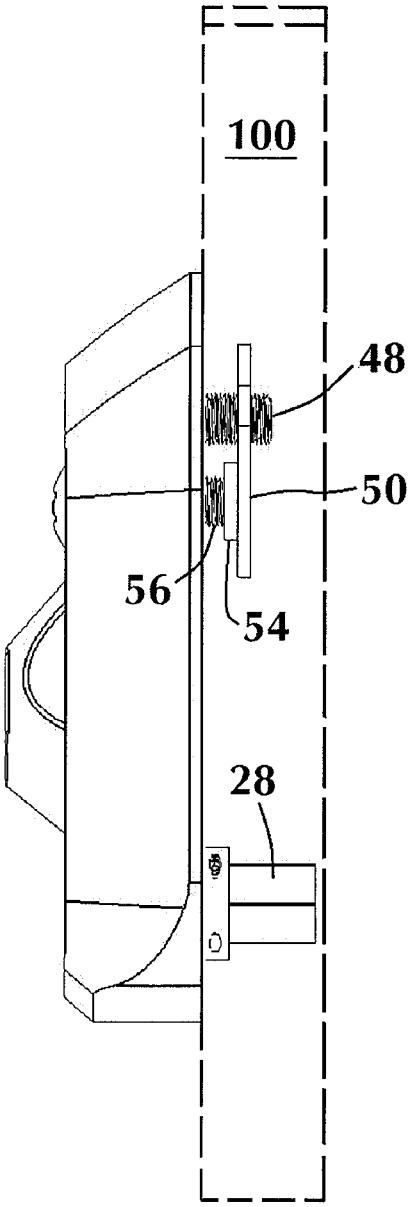
Figure 12:
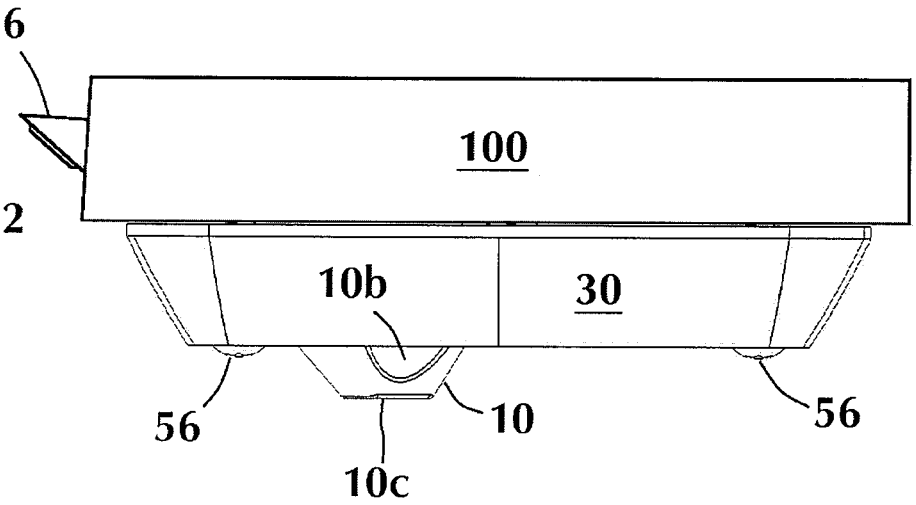
FIG. 12 is a top plan view of the anti-ligature handle and escutcheon mechanism shown in FIG. 6.
Figure 13:
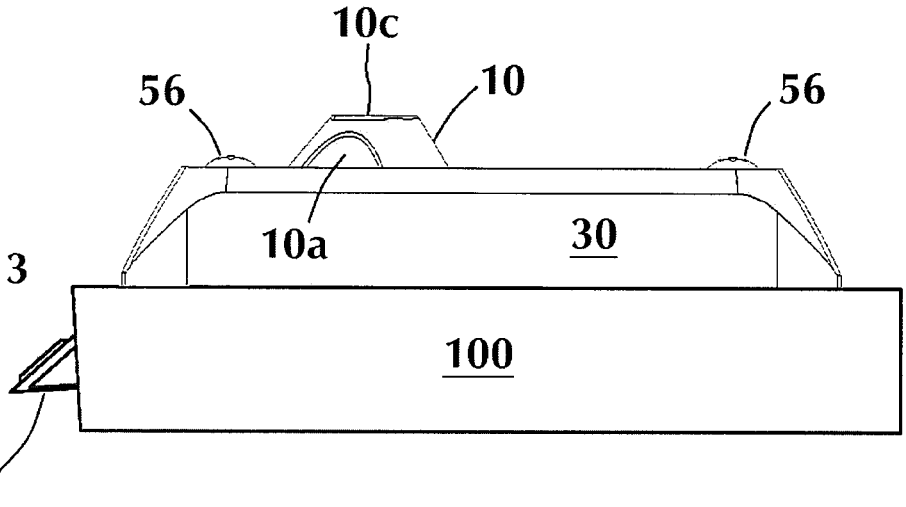
FIG. 13 is a bottom view of the anti-ligature handle and escutcheon mechanism shown in FIG. 6.
Figure 14:
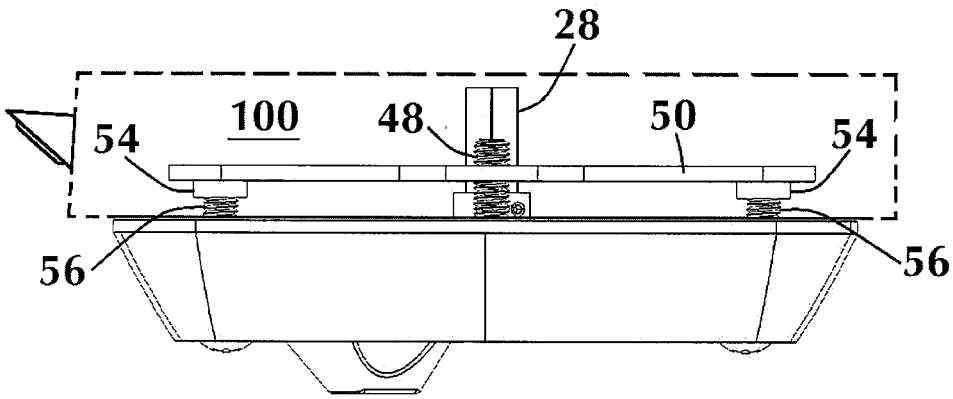
FIG. 14 shows the top plan view of the anti-ligature handle and escutcheon mechanism as seen in FIG. 12, with the exterior surface of the door in phantom line.
Figure 15:
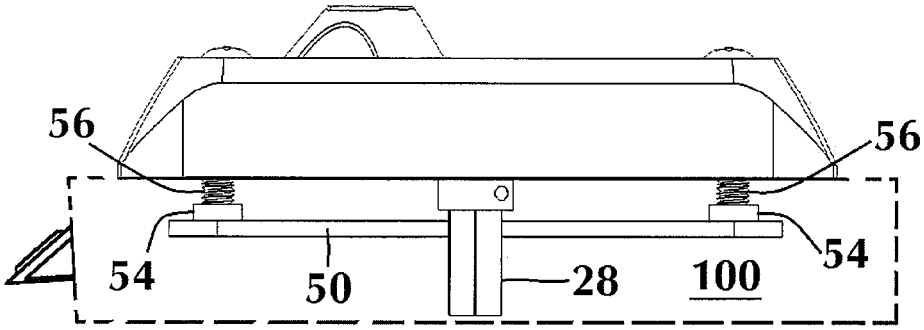
FIG. 15 shows the bottom plan view of the anti-ligature handle and escutcheon mechanism as seen in FIG. 13, with the exterior surface of the door in phantom line.

Referring now to FIG. 7, recess 32 has an apex 32*a* substantially opposite pivot 16 at the first end 12 of the handle. Escutcheon 30 is shaped to hide the pivot 16 and first end 12 of the handle via semi-circular covering 34 positioned substantially opposite apex 32*a* at the base of arched recessed area 32. The second or upper end 14 of the handle slides along an arcuate edge 36 of the recess 32 in the escutcheon 30 as the handle is rotated from a closed position (left, in FIG. 7) to an open position about pivot 16, the second or upper end 14 of the handle crossing from one side of apex 32*a* to its other side during rotation. In the fully closed and fully open positions, the straight edges on opposing sides of the handle 10 are shaped to abut opposing straight edges 36*a*, 36*b* of the recessed area 32.

As can be seen in the exploded view of FIG. 5, the upper end 14 of the thumb turn or handle 10 includes a guide 18 formed as a tab along the top edge thereof. The guide or tab 18 is trapped beneath and slides along arcuate edge 36 of the recessed area 32 of the escutcheon 30 as the handle 10 is rotated to operate the lock (FIG. 7). The guide 18 acts to maintain the back or mating surface of the thumb turn 10 in flush contact with the front surface of backing plate 40 as the handle moves to actuate the lock to prevent ligatures from being inserted between the handle and the backing plate, as can also be seen in FIG. 16.

Guide 18 slides inside the escutcheon 30 just inside curved edge 36 as handle 10 is rotated to actuate the lock mechanism. As best seen in FIG. 4, lip 37 extends along at least a portion of the periphery of arcuate edge 36 and traps the tabbed guide 18 between the inside edge of the escutcheon and the front surface of backing plate 40 to maintain flush contact between the back surface of the handle 10 and the front surface of the backing plate and prevents ligatures from entering therebetween. As shown in FIG. 6, handle second end 14 including guide 18 moves from near a first edge 36*a* of the arched recessed area 32 (closed position, left) to near an opposing edge 36*b* (open position, right) as the handle pivots to operate the lock.

Handle 10 is smoothly curved in all directions and provides no openings allowing a ligature to pass behind the handle. The curves of the handle and escutcheon shape are generally in a downwards direction such that no hanging points are provided and weight cannot be placed upon the handle. The escutcheon 30 is also smoothly curved and provides no projections or hanging points.

As can best be seen in FIG. 7, handle 10 has a substantially uniform width from the first end 12 to the second end 14 and includes depressions or pockets 10*a*, 10*b* on opposite sides of the handle, which do not extend all the way through the handle so as to not form an opening which would provide a hanging point for a ligature. A user may grip within depressions 10*a*, 10*b* which allows the thumb turn 10 to be operated more easily. This shape also allows the handle to be used to pull the door 100 towards the user. Alternatively, the user may operate the thumb turn 10 by pressing inward on flattened portion 10*c* of the top surface of the handle, toward the surface of the door, and applying pressure to the left or right (without gripping the handle) to pivot the thumb turn to operate the lock. The handle depressions 10*a*, 10*b* and/or flat portion 10*c* are particularly beneficial for users such as elderly persons, persons with infirmities, and/or those with limited use of their hands, who must be able to operate the door, such as in hospitals.

Handle 10 is typically biased to the closed position by springs (not shown) located in the lock mechanism. A resilient bumper may be provided in the escutcheon which acts to silently stop the return motion of the handle when the handle is released. As shown in FIG. 7, as the handle or thumb turn 10 is rotated clockwise from left (fully closed position) to right (open position), the lock mechanism 20 is operated to actuate the lock. It should be understood by those skilled in the art that the action of actuating of the lock may include, but is not limited to, retracting the latchbolt 26 (as in FIG. 7), or in other embodiments, retracting or holding back a deadbolt or other suitable mechanism for locking or otherwise securing a door.

As the handle 10 rotates, a rear or mating surface of the handle is in flush contact with backing plate 40 to prevent ligatures from being inserted between the handle and the backing plate as the handle moves to actuate the lock. Referring again to FIG. 16, the backing plate 40 is partially hidden underneath the escutcheon 30, and visible only within recess 32. Backing plate 40 is positioned fully within a rear recessed portion of the escutcheon to allow the periphery of the escutcheon to be in flush contact with the outer surface of the door when mounted thereon.

FIGS. 3 and 4 are rear perspective views showing the configuration of the mounting plate 50, backing plate 40, and escutcheon 30. The door is not shown, for clarity. As can be seen in FIG. 3, backing plate 40 is disposed within the back portion of the escutcheon 30 via rear recess 33, such that a periphery of the escutcheon is permitted to be in flush contact with the outer surface of the door when mounted thereon (FIGS. 8-15). Screws 56 extend between holes 39 in escutcheon 30 through holes 46 in backing plate 40 and into posts 54 (not shown) in mounting plate 50 for final mounting. Studs 38 extending from the back surface of escutcheon 30 adjacent recess edges 36*a*, 36*b* (FIGS. 3-4) mate with blind holes 44 in backing plate 40 to attach the backing plate and escutcheon, providing a dead end at the side angled portions 36*a*, 36*b* of arched recess 32 (FIG. 7). The escutcheon 30 and the backing plate 40 form a stationary unit which is fixed relative to the door 100. In at least one embodiment, the escutcheon 30 and backing plate 40 are both made of stainless steel, although other materials may be used.

As shown in FIGS. 1-5, the anti-ligature handle and escutcheon mechanism of the present invention further includes a mounting or thrubolt plate 50 which is disposed between the backing plate 40 and an inner surface of the door when the anti-ligature handle and escutcheon mechanism is mounted on the outer surface of the door. Mounting plate 50 is fixed relative to the escutcheon and backing plate, and is embedded in the surface of the door and secured thereto via mounting screw 48 which extends through an opening 52 near a top edge of the mounting plate. The mounting plate is embedded in the door and offset a predetermined distance from the escutcheon and backing plate such that the escutcheon 30 can be mounted flush to the outer surface of the door. Screws 56 pass through the escutcheon 30 and backing plate 40 to cooperate with internally threaded posts 54 in the mounting plate 50 for final mounting (FIGS. 1-5 and 8-15).

FIG. 7 is a front elevational view of the anti-ligature handle and escutcheon of the present invention installed on a door that better depicts the appearance of the handle and escutcheon. The handle is smoothly curved down to eliminate any hanging points. The curvature of the handle 10 is such that a user's fingers may be placed into depressions 10*a*, 10*b* and slightly behind the handle flattened portion 10*c* to provide a grip on the handle for pulling the handle and so that the handle may easily be operated.

The space behind flattened portion 10*c* formed by depressions or pockets 10*a*, 10*b* forms a downwardly curved groove or channel which is not open. This prevents attachment of a ligature through the handle 10. As can also clearly be seen in the side elevational views of FIGS. 8-11 and the top and bottom views of FIGS. 12-15, thumb turn or handle 10 is smoothly curved along all directions, such that there are substantially no right angles or projections or any hanging points that would allow attachment of a ligature.

Referring again to FIGS. 6 and 16, it can be seen that any attempt to insert a small diameter ligature, such as dental floss, between the escutcheon 30 and backing plate 40 requires that the ligature be inserted behind the escutcheon recessed portion 32 between the escutcheon 30 and the backing plate 40. By positioning the backing plate within escutcheon rear recessed area 33, as shown in FIGS. 3-4, the angled edges 36*a*, 36*b* of escutcheon recessed area 36 are secured in substantially flush contact with the backing plate 40, preventing insertion of a ligature therein. If by any chance a ligature does pass through any gap between the edges of the escutcheon recess 36 and the backing plate 40, it will project into the dead end formed by the escutcheon 30 and door surface 100, as by positioning the backing plate 40 within escutcheon rear recessed area 33, the periphery of escutcheon 30 is permitted to be in flush contact with the surface of door 100 (FIGS. 8-15).

Thus, the present invention achieves one or more of the following advantages. The anti-ligature handle and escutcheon mechanism provides a handle design that is as easily operated as a lever handle or thumb turn, as opposed to conventional anti-ligature handles which are often difficult to grasp and operate, and further has a handle design that is attractive and provides a modern appearance. The handle and escutcheon design further prevents small diameter ligatures from being inserted into gaps, spaces or joints in the handle, or between the handle and escutcheon, to eliminate all hanging points for such small diameter ligatures. In the present design, the escutcheon surrounds the handle or thumb turn and the thumb turn pivots within a recess in the escutcheon and includes a guide trapped beneath and sliding along an edge of the recessed area of the escutcheon to maintain the handle in flush contact with a backing plate to prevent insertion of a ligature therebetween as the handle rotates to operate the lock. The anti-ligature handle and escutcheon mechanism of the present invention further provides a means for the handle and escutcheon to be mounted flush with an outer surface of the door by way of a mounting plate which is fixed relative to the escutcheon and backing plate and offset a predetermined distance therefrom, such that the mounting plate may be embedded within the door to allow for the escutcheon to be mounted flush with the outer surface of the door.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An anti-ligature handle and escutcheon mechanism mountable on a door for operating a lock for securing the door, the anti-ligature handle and escutcheon mechanism comprising:

a handle rotatable between an open position and a closed position, the handle having a smoothly curved outer surface to prevent the attachment of a ligature thereto, the handle comprising a pivot at a first end for rotating the handle between the open and closed positions to operate the lock;

an escutcheon oriented for mounting parallel to the door when the anti-ligature handle and escutcheon mechanism is mounted on an outer surface of the door, the escutcheon shaped to hide the pivot, said escutcheon defining a recessed area such that the handle rotates within said recessed area;

a backing plate oriented for mounting parallel to the door when the anti-ligature handle and escutcheon mechanism is mounted on the outer surface of the door, a mating surface of the handle being in flush contact with the backing plate as the handle rotates between the open and closed positions to operate the lock to prevent the ligature from being inserted between the handle and the backing plate, the backing plate fixed relative to the escutcheon to prevent the ligature from being inserted between the escutcheon and backing plate; and a mounting plate for embedding within the door between the backing plate and an inner surface of the door when at least a portion of the anti-ligature handle and escutcheon mechanism is mounted flush on the outer surface of the door, the mounting plate fixed relative to the escutcheon and backing plate.

2. The anti-ligature handle and escutcheon mechanism according to claim 1 wherein the mounting plate is offset a predetermined distance from the escutcheon and the backing plate such that at least a portion of the escutcheon can be mounted flush with the outer surface of the door.

3. The anti-ligature handle and escutcheon mechanism according to claim 1 wherein the mounting plate comprises at least one internally threaded post for receiving at least one fastener passing through the backing plate between the escutcheon and the mounting plate.

4. The anti-ligature handle and escutcheon mechanism according to claim 1 wherein the mounting plate further comprises an aperture for receiving a fastener inserted therein to secure the mounting plate to the inner surface of the door.

5. The anti-ligature handle and escutcheon mechanism according to claim 1 wherein the escutcheon surrounds at least a portion of the handle and comprises a covering for hiding the pivot.

6. The anti-ligature handle and escutcheon mechanism according to claim 1 wherein the handle has a substantially uniform width from the first end to a second end opposite the first end.

7. The anti-ligature handle and escutcheon mechanism according to claim 1 wherein the handle is smoothly curved and shaped to allow a user to grip within depressions on opposing sides of the handle, but without providing an opening within the handle.

8. The anti-ligature handle and escutcheon mechanism according to claim 1 wherein the handle includes at least a portion having a flattened surface to allow a user to press the flattened surface of the handle inwards toward the backing plate without gripping the handle to rotate the handle between the open and closed positions to operate the lock.

9. The anti-ligature handle and escutcheon mechanism according to claim 1 wherein the recessed area is shaped approximately as a segmental arch.

10. The anti-ligature handle and escutcheon mechanism according to claim 9 wherein the first end of the handle rotates from a point approximately opposite an apex of the recessed area.

11. The anti-ligature handle and escutcheon mechanism according to claim 9 wherein opposing edges of the recessed area are straight lines emanating from a center point of the first end of the handle.

12. The anti-ligature handle and escutcheon mechanism according to claim 9 wherein the second end of the handle moves from near a first edge of the arched recessed area to near a second edge of the recessed area as the handle rotates between the open and closed positions to operate the lock.

13. The anti-ligature handle and escutcheon mechanism according to claim 1 wherein the handle comprises substantially straight edges which abut opposing edges of the recessed area when the handle is in the closed position and the open position, respectively, as the handle rotates to operate the lock.

14. The anti-ligature handle and escutcheon mechanism according to claim 1 wherein the handle comprises a second end including a guide and the guide is trapped beneath and slides along an arcuate edge of the recessed area of the escutcheon as the handle is rotated between the open and closed positions to operate the lock.

15. The anti-ligature handle and escutcheon mechanism according to claim 14 wherein the arcuate edge of the recessed area of the escutcheon further comprises a lip extending along at least a portion thereof, the lip trapping the guide between an inside edge of the escutcheon and the backing plate to maintain flush contact between the mating surface of the handle and the backing plate as the handle is rotated between the open and closed positions to operate the lock, the flush contact between the mating surface of the handle and the backing plate preventing insertion of the ligature therebetween.

16. The anti-ligature handle and escutcheon mechanism according to claim 1 wherein the escutcheon is smoothly curved and provides no projections or hanging points.

17. The anti-ligature handle and escutcheon mechanism according to claim 1 wherein the backing plate comprises an aperture for receiving at least a portion of the pivot of the handle therethrough.

18. The anti-ligature handle and escutcheon mechanism according to claim 1 wherein the escutcheon has a back surface comprising a rear recessed portion and wherein the backing plate is positioned within the rear recessed portion of the escutcheon such that a periphery of the escutcheon is permitted to be in flush contact with the outer surface of the door when mounted thereon.

19. The anti-ligature handle and escutcheon mechanism according to claim 18 wherein the back surface of the escutcheon further comprises a pair of studs extending therefrom and the backing plate comprises a pair of blind holes for receiving the studs to attach the backing plate to the escutcheon.

20. A method of operating a lock for securing a door, comprising:

providing an anti-ligature handle and escutcheon mechanism mounted on an outer surface of the door, the anti-ligature handle and escutcheon mechanism comprising: a handle rotatable between an open position and a closed position, the handle having a smoothly curved outer surface to prevent the attachment of a ligature thereto, and comprising a pivot at a first end for rotating the handle between the open and closed positions to operate the lock, and a second end including a guide; an escutcheon surrounding the handle and defining a recessed area within which the handle rotates, the escutcheon shaped to hide the pivot; a backing plate mounted parallel to the outer surface of the door, the backing plate fixed relative to the escutcheon to prevent the ligature from being inserted between the escutcheon and backing plate; and a mounting plate embedded within the door between the backing plate and an inner surface of the door such that at least a portion of the escutcheon is mounted flush on the outer surface of the door, the mounting plate fixed relative to the escutcheon and backing plate, wherein the guide of the second end of the handle is trapped beneath an arcuate edge of the recessed area of the escutcheon such that the guide is permitted to slide along the arcuate edge as the handle is rotated between the open and closed positions to operate the lock; and rotating the handle between open and closed positions while maintaining a mating surface of the handle in flush contact with the backing plate as the handle rotates between the open and closed positions to operate the lock, so as to prevent the ligature from being inserted between the handle and the backing plate.

* * * * *